US005509528A

United States Patent [19]

Weisburn

[11] Patent Number: 5,509,528

[45] Date of Patent: Apr. 23, 1996

[54] DISPLAY PACKAGE

[75] Inventor: James T. Weisburn, Massillon, Ohio

[73] Assignee: Alpha Enterprises, Inc., North Canton, Ohio

[21] Appl. No.: 340,545

[22] Filed: Nov. 16, 1994

[51] Int. Cl.[6] ..... B65D 25/22

[52] U.S. Cl. ..... 206/45.24; 206/308.1; 206/387.1; 206/776; 206/806; 220/481

[58] Field of Search ..... 206/44 R, 45.2, 206/45.24, 806, 308.1, 387.1; 220/480–482; 248/222.4, 225.1, 225.2, 231.91

[56] References Cited

U.S. PATENT DOCUMENTS

| | | | |
|---|---|---|---|
| 3,186,557 | 6/1965 | Wise | 206/44 R |
| 3,302,917 | 2/1967 | Winkler | 206/806 |
| 3,526,314 | 9/1970 | Trammell, Jr. | 220/481 |
| 3,695,418 | 10/1972 | Gwozdz | 206/806 |
| 4,347,930 | 9/1982 | Herrin | 206/806 |
| 4,349,102 | 9/1982 | Strongwater | 206/806 |
| 4,356,919 | 11/1982 | Matney | 206/806 |
| 4,632,242 | 12/1986 | Choi et al. | 206/806 |
| 5,148,914 | 9/1992 | Budert et al. | 206/807 |

*Primary Examiner*—Jimmy G. Foster
*Attorney, Agent, or Firm*—Sand & Sebolt

[57] ABSTRACT

A display package for displaying an article contained therein in a plurality of positions. The package has a base, a lid hingedly mounted on the base, and a lock mechanism for securing the lid in a locked position on the base. The lid has a top wall formed with a plurality of mounting recesses adjacent an endwall and a sidewall for receiving the legs of a hanger therein. Each leg extends outwardly from a diamond-shaped body, and includes an upper portion coplanar with the body, a lower portion and a stepped shoulder extending between the upper and lower portions. Each lower portion also includes a foot extending toward the other leg. Each recess includes a flange extending over a portion thereof, and each flange has a nub extending outwardly therefrom. The foot of each leg is slidably received within a respective recess and slides past the nub which removably retains the hanger in a selected pair of recesses. The hanger is selectively positioned in a selected pair of recesses adjacent the endwall or the sidewall so that the display box may be oriented in at least two different positions to provide optimum viewing of the article enclosed therein.

19 Claims, 3 Drawing Sheets

DISPLAY PACKAGE

BACKGROUND OF THE INVENTION

1. Technical Field

The invention relates generally to display packages of the type for holding merchandise in retail stores such as game cartridges, audio and video cassettes, and software. More particularly, the invention relates to display packages which are suspended from a display hook. Specifically, the invention relates to display packages which may be suspended from a display hook in a variety of predetermined positions.

2. Background Information

Audio and video cassettes and compact discs have increased in popularity over the past several years and have become an important segment of the recording and movie industry. Similarly, software and optical discs, as well as game cartridges have become increasingly popular as the compatibility of the electronics has increased while the price of electronics has continued to decrease. These general types of recording media, while drastically different in shape, generally perform the function of transferring information from the recording media to the user via audio and/or visual output.

In recent times, recording media has become interactive further increasing the popularity and profitability of merchandising these products. These general types of recording media are displayed in retail stores for sale and/or rental in a variety of display packages. It is important in the recording media market, and especially in the game cartridge market, to repackage the media in a display package which reduces theft of the package and/or contents from the retail store. While various types of display packages have been developed, each such package is generally limited to retaining a media having a specific size and configuration. Moreover, the display packages which have been developed generally may only be displayed in one preselected position substantially reducing the retail store's ability to customize a display area to increase it's attractiveness to customers, or to optimize the store's available merchandising space, or to properly orient the graphics on the article contained within the package.

Although known display packages are presumably adequate for the purpose for which they are intended, they present a number of additional problems. Specifically, each style security package is often opened with a separate key increasing the number of keys that must be manufactured by the supplier and stocked for use by the retailer, substantially increasing operating cost.

Similarly, many existing display packages, whether or not the package will lock, are manufactured to be displayed in a preselected position. The retailer thus utilizes one display package to display items in a vertical position, and a second display package when displaying products in a horizontal orientation which significantly increases costs to the retailer. Specifically, known display devices are generally formed with a hanger attached to either an end portion or a side portion of the package to suspend the display package from a display hook in either the vertical or horizontal direction. Known display packages do not permit relocation of the hanger from one position to another position on the package so that the display package may be suspended with a single hanger selectively attached either adjacent an endwall or adjacent a sidewall of the package.

Therefore, the need exists for an improved display package for displaying merchandise for sale, including audio and video cassettes, game cartridges and software in which the merchandise is maintained in its usual packaging, but when placed in the security display package, may be suspended from a display hook in a variety of preselected positions to better display the package or to properly orient the graphics within the package for ease of review by a prospective purchaser. Moreover, the need exists for a display package which includes a single hook which may be removably positioned adjacent either an end wall or a sidewall of the display package to assure that the product enclosed within the display package is properly oriented for merchandising. Further, the need exists for a display package wherein both the hook and display box are reusable, and wherein the hook may be repeatedly moved from adjacent an endwall to adjacent a sidewall of the display package for selectively orienting an object enclosed within the display package to the correct merchandising position.

SUMMARY OF THE INVENTION

Objectives of the invention include providing an improved display package which can be suspended from a display hook in one of a plurality of preselected positions.

Another objective of the invention is to provide such an improved display package in which a single hanger may be removably fastened to the display box in a plurality of predetermined locations such that the display package may be suspended from a display hook, both of the single peg and hoop configurations, in a variety of orientations relative to the display hook.

Yet another objective of the invention is to provide such a display package which will house items having a variety of sizes and configurations, including game cartridges and software packages for various game and computer systems.

A still further objective of the invention is to provide a display package which permits the display package to be suspended in such a manner that the enclosed object, including the enclosed graphics, is correctly oriented for a customer to view.

A further objective of the invention is to provide a display package which is lockable to prevent removal of the contents therefrom.

Still another objective of the invention is to provide a display package for housing an object which is reusable, and in which the hanger is movable between two positions on the display package such that the same hanger may be repeatedly moved between these two positions to correctly orient the display package for each particular article housed therein.

A further objective of the invention is to provide such a display package which is of a relatively simple construction, yet which achieves the stated objectives in a simple, effective and inexpensive manner, and which solves problems and satisfies needs existing in the art.

These and other objectives and advantages are obtained by a display package for housing an item, the general nature of which may be stated as including a display box having a side and an end; a hanger removably attached to the display box; and mounting means formed in the display box adjacent one of the side and end for removably mounting the hanger to the display box adjacent said one of the side and end.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
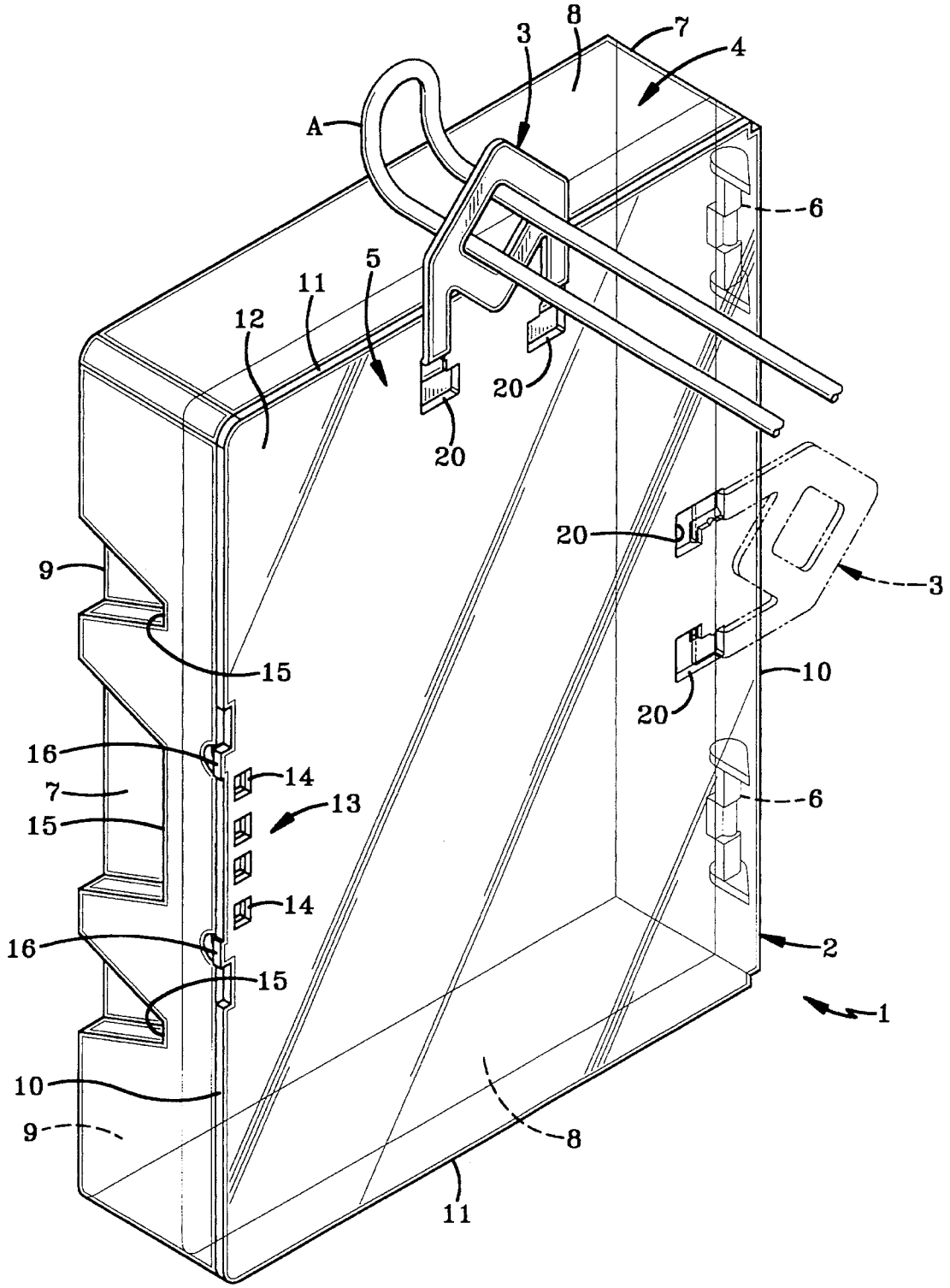
FIG. 1 is a perspective view of the improved display package for displaying an article, shown suspended from a loop type of display hook, and shown with the hanger in a first position in solid lines, and in a second position in dot-dash lines.

The display package of the present invention is indicated generally at 1, and is shown particularly in FIG. 1 suspended from a usual loop type of display hook A. Display package 1 includes a display box 2 and a hanger 3. Display box 2 includes a base 4 and a lid 5 hingedly attached to base 4 by a plurality of hinges 6. Base 4 is rectangular and includes a pair of parallel and spaced apart sidewalls 7, a pair of parallel and spaced apart endwalls 8 perpendicular to sidewalls 7, and a bottom wall 9 perpendicular to sidewalls 7 and endwalls 8. Similarly, lid 5 includes a pair of parallel and spaced apart sidewalls 10, a pair of parallel and spaced apart endwalls 11 substantially perpendicular to sidewalls 10, and a top wall 12.

Hinges 6 are connected to one of the sidewalls 7 and 10 to provide hinged movement between base 4 and lid 5. A lock mechanism indicated generally at 13 operates between the other of the sidewalls 7 and 10 (FIG. 1). Lock mechanism 13 may take a variety of configurations, and operate in a variety of ways. In the preferred embodiment, lock mechanism 13 is of the type described in pending patent application Ser. No. 08/008,632 entitled "Security Container and Release Key Therefor", the contents of which are fully incorporated herein by reference. Lock mechanism 13 includes a plurality of key holes 14 formed in lid 5, a plurality of trapezoid shaped slots 15 formed in sidewall 7, and a plurality of catch areas 16 to facilitate the opening of lid 5 with respect to base 4.

Figure 3:
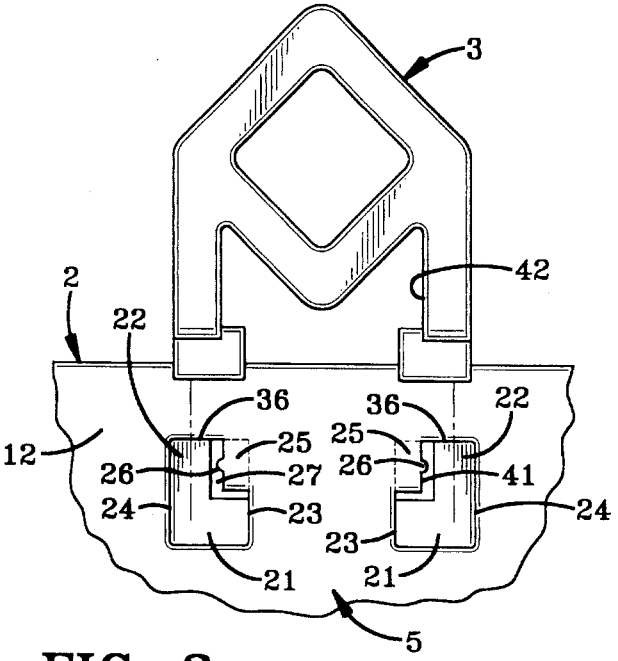
FIG. 3 is an exploded fragmentary elevational view of the display package.

In accordance with one of the main features of the present invention, top wall 12 of lid 5 is formed with a pair of rectangular recesses 20 adjacent one sidewall 10 and another pair of recesses 20 formed adjacent one end wall 11. Referring to FIG. 3, each recess 20 includes a lower half 21 and an upper half 22 which are formed by an inner sidewall 23 and an outer sidewall 24, with sidewall 24 being appropriately twice the length of sidewall 23. A right angle flange 25, coplanar with top wall 12 of lid 5 extends outwardly from inner sidewall 23 toward sidewall 24 and over a portion of upper half 22 of recess 20. Each flange 25 includes a nub 26 which extends outwardly from an outer edge 41 thereof, and towards outer sidewall 24. Each recess 20 is formed with an L-shaped hole 27 in upper half 22 thereof which is located adjacent flange 25.

Figure 2:
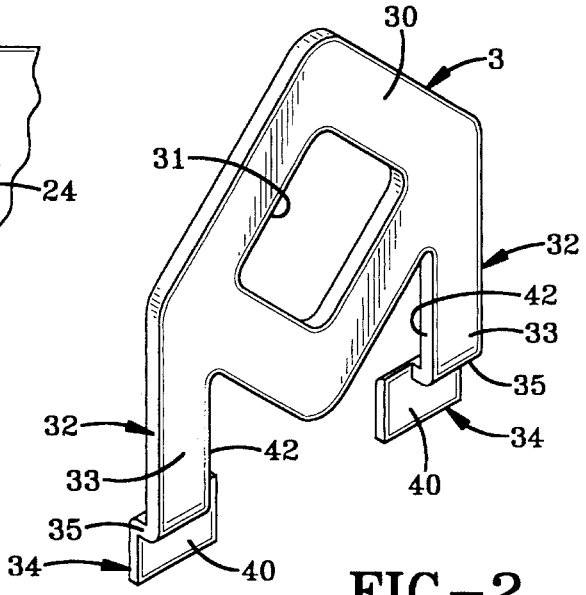
FIG. 2 is a perspective view of the hanger, per se.
Figure 4:
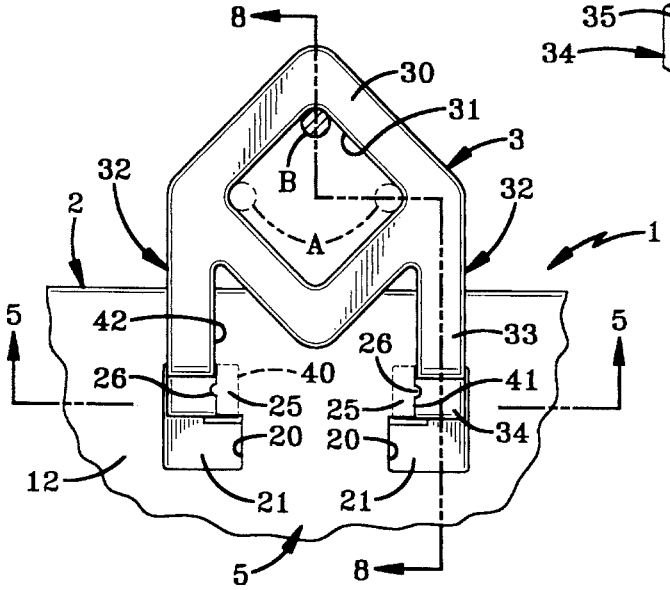
FIG. 4 is a fragmentary elevational view of the display package with the hanger in a mounted position therein.
Figure 5:
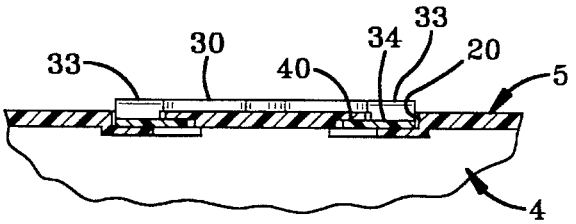
FIG. 5 is a fragmentary sectional view taken along line 5—5, FIG. 4.

In accordance with another of the main features of the present invention, and referring specifically to FIGS. 2 and 4, hanger 3 includes a diamond-shaped body 30 having a central similarly shaped opening 31 for receiving a display hook. A pair of spaced parallel legs 32 extend downwardly from diagonal corners of body 30. Each leg 32 includes an upper section 33 coplanar with body 30, and a lower stepped section 34. Section 34 includes a right angled shoulder 35 extending between upper section 33 and a lower planar foot 40. Shoulder 35 is substantially perpendicular to section 33 and foot 40 and is substantially equal to the depth of recess 20. Each foot 40 extends outwardly beyond an inner edge 42 of leg 32 towards the other leg 32. Hanger 3 preferably is formed of a plastic material.

Figure 6:
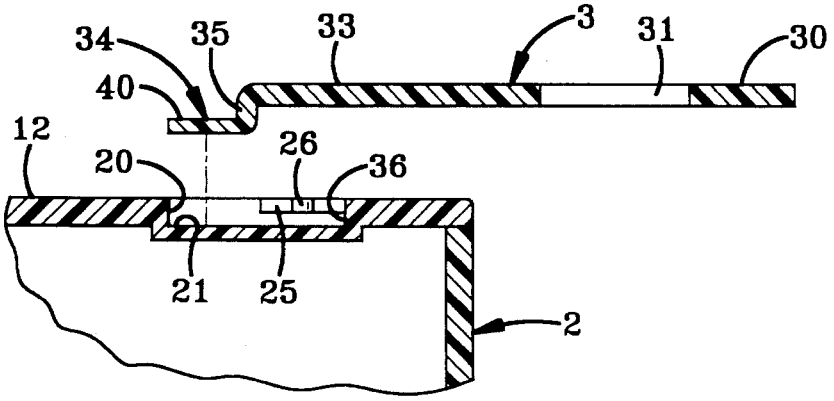
FIG. 6 is an exploded fragmentary sectional view of the display package shown with the hanger ready to be installed on the display box.

Lower half 21 of each recess 20 is complementarily shaped to accept a respective leg 32 (FIGS. 3 and 6). Similarly, upper half 22 of each recess 20 is sized to receive foot 40 of each leg 32 with the extended end portion of foot 40 extending under flange 25 and the remaining portion of foot 40 extending between edge 41 of flange 25 and outer sidewall 24.

The distance between edges 41 of flanges 25 and sidewalls 24 is equal to the width of legs 32 such that when hanger 3 is in the position shown in FIG. 4, inner edges 42 of legs 32 are in contact with flange edges 41, shoulder 35 is in contact with recess 20 and foot 40 extends under flange 25. As shown in FIG. 4, each boss 26 extends outwardly from flange 25 and into upper half 22 of recess 20 beyond inner edge 42 of a respective leg 32 to trap hanger 3 in the recess.

In operation, hanger 3 is positioned over display box 2 such that foot 40 of each leg 32 is positioned over lower half 21 of each recess 20 as shown in FIG. 6. Thereafter, hanger 3 is moved in the direction of arrow A (FIG. 7) until foot 40 of each leg 32 is in a respective lower half 21 of each recess 20. Referring then to FIG. 8, hanger 3 is moved along the direction of arrow B until each shoulder 35 is in contact with an upper wall 36 of recess 20.

Figure 7:
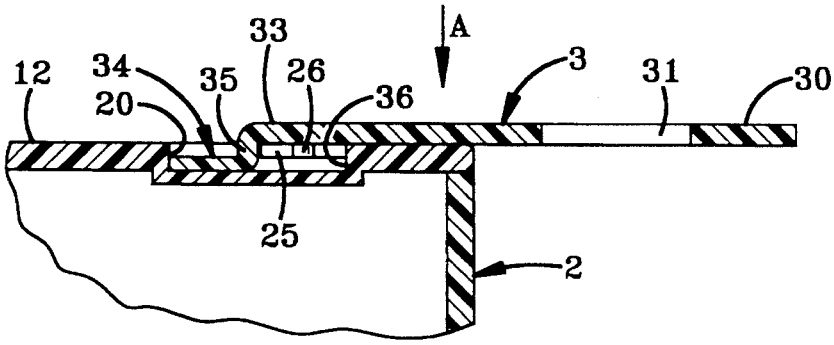
FIG. 7 is a fragmentary sectional view of the display package of FIG. 6 shown with the hanger partially installed on the display box.
Figure 8:
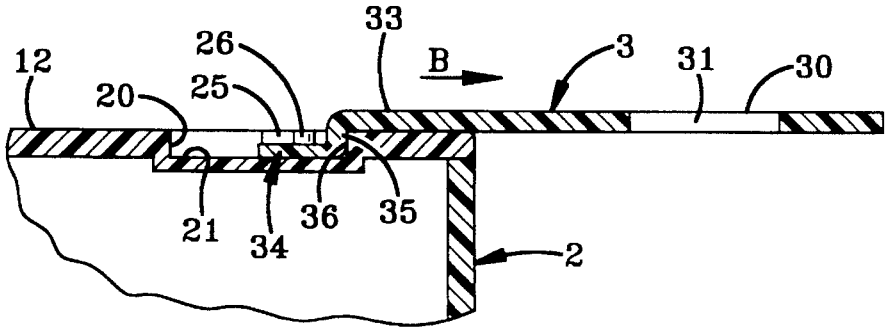
FIG. 8 is a fragmentary sectional view of the display package taken substantially along line 8—8, FIG. 4 and shown with the hanger installed on the display box.

As hanger 3 is moved in the direction of arrow B, from the position shown in FIG. 7 to the position shown in FIGS. 4 and 8, shoulder 35 of each leg 32 will move past each nub 26. Once each shoulder 35 has passed nub 26 and has moved to the position shown in FIGS. 4 and 8, hanger 3 is retained in position via the engagement of each nub 26 with shoulder 35. While shoulder 35 slides over nub 26, the extended ends of each foot 40 moves into upper half 22 of recess 20 beneath flange 25. This provides a generally snap-fit mounting of hanger 3 in recess 20.

Hanger 3 of display package i may be removably mounted in recesses 20 adjacent endwall 11, or alternatively hanger 3 may be removably mounted in recesses 20 adjacent sidewall 10. The mounting position of hanger 3 relative to display box 2 is entirely dependent upon the object or article to be displayed therein. If the graphics of the enclosed article is best displayed when hanger 3 is positioned adjacent sidewall 10, for example when the product is wider than it is tall, then hanger 3 is so positioned. Alternatively, if the graphics of the object enclosed in display box 2 is best viewed when display package 1 is positioned as shown in FIG. 1, hanger 3 is positioned adjacent endwall 11, for example when the object enclosed in display box 2 is taller than it is wide.

Likewise, the horizontal distance between the two inner corners of hanger 3 is substantially equal to the separation of the two rods which form loop hook A, as shown in FIGS. 1 and 4, which enables hanger 3 to slidably hang display box 2 therefrom in a stable position. Also, the topmost inner corner of hanger 3 receives the rod (indicated at B in FIG. 4) of a single hook for suspending display box 2 therefrom in a self-centering manner when only a single rod type of display hook is used.

Display package 1 is preferably manufactured of a transparent or translucent material to permit visual inspection of the article enclosed within display box 2.

In summary, display package 1 includes a display box 2 and hanger 3, such that an article is enclosed within display box 2, hanger 3 may be selectively positioned adjacent sidewall 10 or alternatively adjacent endwall 11. In this manner, hanger 3 may be positioned on display box 2 in the manner which orients box 2 in the position most favorable for viewing the article enclosed therein. Moreover, hanger 3 may be selectively moved easily from a position adjacent sidewall 10 to a position adjacent endwall 11 on display box 2 as objects having different sizes and configurations are subsequently housed within the display box.

Likewise, lock mechanism 13 will securely retain the article, which is easily viewed through the transparent walls of box 2, within package 1 until opened by a key at a checkout counter.

Accordingly, the improved display package for housing an object is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved display package is constructed and used, the characteristics of the construction, and the advantageous, new and useful results obtained; the new and useful structures, devices, elements, arrangements, parts and combinations, are set forth in the appended claims.

I claim:

1. A display package for holding an article, said display package comprising:

a display box having a side and an end;

a hanger formed with a pair of legs removably attached to the display box;

mounting means including a pair of recesses formed in the display box adjacent one of the side and end for removably mounting the hanger to the display box adjacent said one of the side and end by said recesses accepting the legs of the hanger; and each of the hanger legs having a stepped shoulder engageable with a nub formed adjacent each of the recesses for retaining the hanger on the display box.

2. A display package for holding an article therein; said package including a base;

a lid movably mounted on the base between open and closed positions;

means for securing the lid in the closed position;

hanger means removably mounted on either the base or lid for suspending the package on a support; and mounting means formed on one or both of the base and lid for removably receiving the hanger means for suspending the package in a plurality of display positions on the support, said mounting means including two pairs of recesses oriented 90° from each other.

3. The display package defined in claim 2 in which the hanger means includes a pair of legs; and in which the legs are selectively received and retained in the pairs of recesses.

4. The display package defined in claim 3 in which each of the legs includes a foot; in which each of the recesses includes a flange; and in which the foot of each leg is slidably received beneath a respective flange for retaining the leg in said recess.

5. A display package for holding an article, said display package comprising:

a display box having a side and an end;

a hanger removably attached to the display box, said hanger being formed with a diamond-shaped body having diagonally opposite corners and a pair of mounting legs extending from said corners; and mounting means formed in the display box adjacent one of the side and end for removably mounting the hanger to the display box adjacent said one of the side and end.

6. A display package for holding an article, said display package comprising:

a display box having a side and an end;

a hanger removably attached to the display box;

mounting means formed in the display box adjacent both the side and end for selectively removably mounting the hanger to the display box adjacent said side and end, said hanger being formed with at least one mounting leg having a foot extending substantially perpendicular to said leg; and the mounting means including a recess having a flange extending over a portion of said recess for accepting the mounting leg of the hanger therein and for receiving the foot of the mounting leg of the hanger under said flange.

7. A display package as defined in claim 6 further including retaining means for retaining the mounting leg under the flange.

8. A display package as defined in claim 7 in which the retaining means includes a nub formed on the flange; in which the nub extends outwardly from the flange; and in which the mounting leg of the hanger frictionally engages the nub to retain the hanger on the display box.

9. A display package as defined in claim 6 in which the recess has a lower half sized to accept a portion of the leg and the foot, and an upper half having a pair of sidewalls; in which the flange extends outwardly from one of said sidewalls over a portion of the upper half of the recess, toward the other of said sidewalls; and in which the leg passes between the flange and said other sidewall.

10. A display package as defined in claim 9 in which a nub extends outwardly from the flange; and in which the distance between the nub and said other sidewall is smaller than the width of the leg.

11. A display package as defined in claim 6 in which the hanger is formed with a pair of legs; in which the mounting means includes a pair of recesses; and in which each recess accepts a respective leg of the hanger.

12. A display package as defined in claim 6 in which the hanger is formed with a diamond-shaped body having diagonally opposite corners and a pair of mounting legs extending from said corners.

13. A display package as defined in claim 6 in which the display box has a base and a lid hingedly attached to the base; and in which the mounting means is formed in said lid.

14. A display package as defined in claim 13 further including lock means for releasably securing the base to the lid preventing unauthorized removal of an enclosed article from the display box.

15. A display package as defined in claim 13 in which the base and lid are each formed by a pair of parallel and spaced apart sidewalls, and a pair of parallel spaced apart endwalls; in which the base is formed with a bottom wall substantially perpendicular to the sidewalls and endwalls; and in which the lid is formed with a top wall substantially perpendicular to the sidewalls and endwalls; and in which the mounting means is formed in one of the top wall and bottom wall of the lid and base.

16. A display package as defined in claim 6 in which the display box is at least one transparent wall for viewing of an article contained therein.

17. A display package for holding an article, said display package comprising:

a display box having a side and an end;

a hanger removably attached to the display box, said hanger being formed with at least one mounting leg;

mounting means formed in the display box positioned adjacent both the side and the end for removably mounting the hanger to the display box adjacent said one of the side and end, said mounting means including a recess for accepting the mounting leg of the hanger;

a flange extending over a portion of the recess for receiving a foot of the mounting leg of the hanger thereunder; and said retaining means further including a nub formed on and extending outwardly from the flange, with the mounting leg of the hanger frictionally engaging the nub to retain the hanger on the display box.

18. A display package for holding an article therein; said package including a base;

a lid movably mounted on the base between open and closed positions;

means for securing the lid in the closed position;

hanger means for selectively removably mounting on one of the base and lid for suspending the package on a support; and a pair of mounting means formed on one or both of the base and lid and oriented 90° from each other for selectively removably receiving the hanger means for selectively suspending the package in two display positions oriented 90° with respect to each other on the support.

19. A display package as defined in claim 18 in which the hanger is formed with a diamond-shaped body having diagonally opposite corners and a pair of mounting legs extending from said corners.

* * * * *